US006254984B1

(12) United States Patent
Iyori

(10) Patent No.: US 6,254,984 B1
(45) Date of Patent: Jul. 3, 2001

(54) MEMBERS WITH MULTI-LAYER COATINGS

(75) Inventor: Yusuke Iyori, Tokyo (JP)

(73) Assignee: Hitachi Tool Engineering, Ltd., Tokyo (JP)

( * ) Notice: Subject to any disclaimer, the term of this patent is extended or adjusted under 35 U.S.C. 154(b) by 0 days.

(21) Appl. No.: 09/267,357

(22) Filed: Mar. 15, 1999

(30) Foreign Application Priority Data

Mar. 16, 1998 (JP) ..... 10-084957
Mar. 10, 1999 (JP) ..... 11-063234

(51) Int. Cl.[7] ..... B32B 7/02

(52) U.S. Cl. ..... 428/336; 428/697; 428/698; 428/699; 428/701

(58) Field of Search ..... 428/216, 336, 428/657, 698, 699, 701

(56) References Cited

U.S. PATENT DOCUMENTS

| | | | | |
|---|---|---|---|---|
| 4,554,201 | * | 11/1985 | Andreev et al. | 428/698 |
| 4,643,951 | * | 2/1987 | Keem et al. | 428/699 |
| 4,984,940 | * | 1/1991 | Bryant et al. | 428/698 |
| 5,035,957 | * | 7/1991 | Bartlett et al. | 428/552 |
| 5,330,853 | * | 7/1994 | Hofmann et al. | 428/699 |
| 5,503,912 | * | 4/1996 | Setoyama et al. | 428/697 |
| 5,549,975 | * | 8/1996 | Schulz et al. | 428/553 |
| 5,679,448 | * | 10/1997 | Kawata | 428/216 |
| 5,879,823 | | 3/1999 | Prizzi et al. . | |

FOREIGN PATENT DOCUMENTS

| | | |
|---|---|---|
| 197 52 644 | 6/1998 | (DE) . |
| 0 709 353 | 5/1996 | (EP) . |
| 62-142768 | 6/1987 | (JP) . |
| 62-56565 | 12/1987 | (JP) . |
| B 5-67705 | 9/1993 | (JP) . |
| A 7-328811 | 12/1995 | (JP) . |
| 7-328812 | 4/1996 | (JP) . |
| 9-323204 | 12/1997 | (JP) . |
| 10-128605 | 5/1998 | (JP) . |

* cited by examiner

*Primary Examiner*—Archene Turner
(74) *Attorney, Agent, or Firm*—Sughrue, Mion, Zinn, Macpeak & Seas, PLLC

(57) ABSTRACT

In the multi-layer-coated member composed of an ultra-hard alloy substrate and a multi-layer coating formed thereon, the multi-layer coating comprises two or more first layers each composed of at least one of carbides, nitrides and carbonitrides of elements of Groups 4a, 5a and 6a of the Periodic Table and Al, and two or more second layers each composed of at least one of oxides, carboxides, oxinitrides and carboxinitrides of elements of Groups 4a, 5a and 6a of the Periodic Table and Al laminated alternately. The first layers adjacent via the second layer are continuous in crystal orientation.

15 Claims, 4 Drawing Sheets

MEMBERS WITH MULTI-LAYER COATINGS

BACKGROUND OF THE INVENTION

The present invention relates to a multi-layer-coated member constituted by an ultra-hard alloy substrate of high-speed steel, cemented carbides, cermets, etc. coated with a plurality of layers excellent in oxidation resistance and/or wear resistance, particularly those suitable for cutting tools such as drills, end mills, throwaway chips for milling machines, etc.

Many attempts have already been reported to provide ultra-hard alloy substrates such as high-speed steel, cemented carbides, cermets, etc. with ceramic coatings excellent in oxidation resistance and wear resistance, thereby achieving long life due to an effective combination of their properties. The coating layers of coated tools have widely been composed of TiN, TiCN, etc. excellent in wear resistance. However, metal nitrides such as TiN are easily oxidized at high temperatures, resulting in extreme deterioration of wear resistance.

To solve the problems of the oxidation of TiN coatings, proposal has recently be made to add Al to these coatings to improve their wear resistance, oxidation resistance, etc. See Japanese Patent Laid-Open No. 62-56565, and Japanese Patent Publication Nos. 4-53642 and 5-67705.

The coating methods of ultra-hard alloy substrates are generally classified to chemical vapor deposition (CVD) methods and physical vapor deposition (PVD) methods. It is known that coatings formed by the PVD methods such as an ion plating method, a sputtering method, etc., serve to improve the wear resistance of the substrates without deteriorating their mechanical strength. Accordingly, cutting tools such as drills, end mills, and throwaway chips for milling machines that require high mechanical strength and chipping resistance are coated by the PVD methods at present.

In the above Al-containing coating layers proposed by Japanese Patent Laid-Open No. 62-56565, for instance, coating layers composed of carbides, nitrides or carbonitrides of Ti and Al provide ultra-hard alloy substrates with higher oxidation resistance and wear resistance than those containing no Al. It is, however, pointed out that the Al-containing coating layers rather deteriorate the mechanical properties of the ultra-hard alloy substrates. While the inclusion of Al into the coatings leads to improvement in the chemical properties of the coating surfaces, it deteriorates the fracture toughness of the coatings. Particularly when coated ultra-hard alloys are used for high-speed cutting tools, their teeth are extremely heated, resulting in oxidation and rapid wearing of the coatings and deterioration of the coatings by thermal shock and galling, and thus a decrease in life.

Cutting speeds are recently increasing, and severe cutting conditions are required in many cases as in the cutting of heat-treated high-speed steel. To cope with such conditions, improvement is desired.

Also proposed is the formation of an outermost layer of TiAlON, etc. to improve the oxidation resistance of the coated members (Japanese Patent Laid-Open No. 7-328811). However, the mere formation of an outermost layer consisting of oxides of Ti and Al fails to provide enough oxidation resistance to withstand severe working conditions.

It is further proposed that alumina layers generally formed by CVD methods are formed as outermost layers by ion plating methods (Japanese Patent Laid-Open No. 9-192906). However, the alumina layers formed by the PVD methods do not have sufficient adhesion to the underlying layers, resulting in peeling of the alumina layers by impact in actual cutting operation.

OBJECT AND SUMMARY OF THE INVENTION

In view of the fact that in a high-speed cutting operation which has become commonplace recently, cutting tools are extremely heated at their teeth, sometimes higher than temperatures at which oxidation starts in the coating layers, the present invention is aimed at providing coated members capable of carrying out a stable cutting operation under such severe conditions with a long life.

As a result of research on the oxidation mechanism of a TiAlN layer to achieve the above objects, the inventor has found that alternately laminating first layers each and second layers each can provide a multi-layer coating having excellent oxidation resistance and wear resistance. The present invention has been completed based upon this finding.

Thus, the multi-layer-coated member according to the present invention is composed of an ultra-hard alloy substrate and a multi-layer coating formed thereon, wherein the multi-layer coating comprises two or more first layers and two or more second layers laminated alternately, the first layer being composed of at least one selected from the group consisting of carbides, nitrides and carbonitrides of at least one element of Groups 4a, 5a and 6a of the Periodic Table and Al, and the second layer being composed of at least one selected from the group consisting of oxides, carboxides, oxinitrides and carboxinitrides of at least one element of Groups 4a, 5a and 6a of the Periodic Table and Al.

In a preferred embodiment, the first layers adjacent via the second layer have crystals whose orientations are substantially the same, because the second layer is extremely thin as compared with the first layer. The state that the first layers have the same crystal orientation may be called that the first layers have "crystal continuity" via the second layer. The crystal orientation of the first layer determined by the maximum intensity of X-ray diffraction is aligned along the (200) face. The first layer preferably has an fcc crystal structure.

The first layer may comprise 1–30 atomic % of at least one additional element selected from the group consisting of Si, Y, Nd, Sm and Sc.

In another preferred embodiment, the multi-layer coating has an outermost layer composed of at least one selected from the group consisting of oxides, carboxides, oxinitrides and carboxinitrides of at least one element of Groups 4a, 5a and 6a of the Periodic Table and Al. The outermost layer is preferably composed of at least one selected from the group consisting of oxides, carboxides, oxinitrides and carboxinitrides of Ti and Al, particularly Ti, Si and Al, more particularly Al. The outermost layer may be amorphous or crystalline.

In a further preferred embodiment, the multi-layer coating has an innermost layer having excellent adhesion to the substrate, the innermost layer is composed of at least one of TiN, TiCN, Ti and TiAl and having a thickness from 2 nm to 5000 nm.

DETAILED DESCRIPTION OF THE PREFERRED EMBODIMENTS

The present invention will be described in detail below, taking an example that the first layer is composed of TiAlN having excellent oxidation resistance, and that the second layer is composed of TiAlON, without intention of limiting the present invention thereto.

When a TiAlN layer is subjected to an oxidation test in the air, Al near the coating surface is diffused toward the outermost layer to form alumina. According to research by the inventor, the formation of alumina suppresses the diffusion of oxygen deep inside the multi-layer coating, thereby improving oxidation resistance. In this case, a coating layer immediately under alumina is oxidized to form titanium oxide having a rutile structure that does not contain Al because of its diffusion to the outermost layer. This titanium oxide is extremely porous. Though alumina formed on the outermost layer acts as a barrier to oxygen diffusion in a static oxidation test, the outermost alumina easily peels from the porous titanium oxide layer during a cutting operation. As a result, the outermost alumina layer fails to exhibit full barrier effects to oxidation when put into actual use.

With a laminate structure in which an oxygen-containing second layer such as a TiAlON layer is sandwiched by the first layers of TiAlN, however, the second layer underlying the first layer functions as a barrier to oxygen diffusion. As a result, oxidation is prevented from proceeding inside the coating, even though the TiAlN first layer existing on the outermost side is turned into a porous titanium oxide layer. Particularly during the cutting operation, oxidation is drastically suppressed from diffusing inside the coating, thereby ensuring stable cutting with a long life.

When the first layer of TiAlN peels off by oxidation, the underlying TiAlON second layer is exposed, and the TiAlON second layer then peels or wears off. In such a case, the further underlying TiAlN first layer is exposed as an outermost layer, and the TiAlON second layer under the newly exposed TiAlN first layer similarly functions as a barrier to oxygen diffusion to impart oxidation resistance to the coating. Accordingly, the number of the second layers included in the multi-layer coating of the present invention should be as many as possible, preferably 10 or more, particularly 50–500, to achieve sufficient cutting life. Particularly when the total thickness of the multi-layer coating is 2–3 $\mu$m, the number of the second layers may be about 200. Also, when the total thickness of the multi-layer coating is 5–8 $\mu$m, the number of the second layers may be about 400–500.

Figure 1:
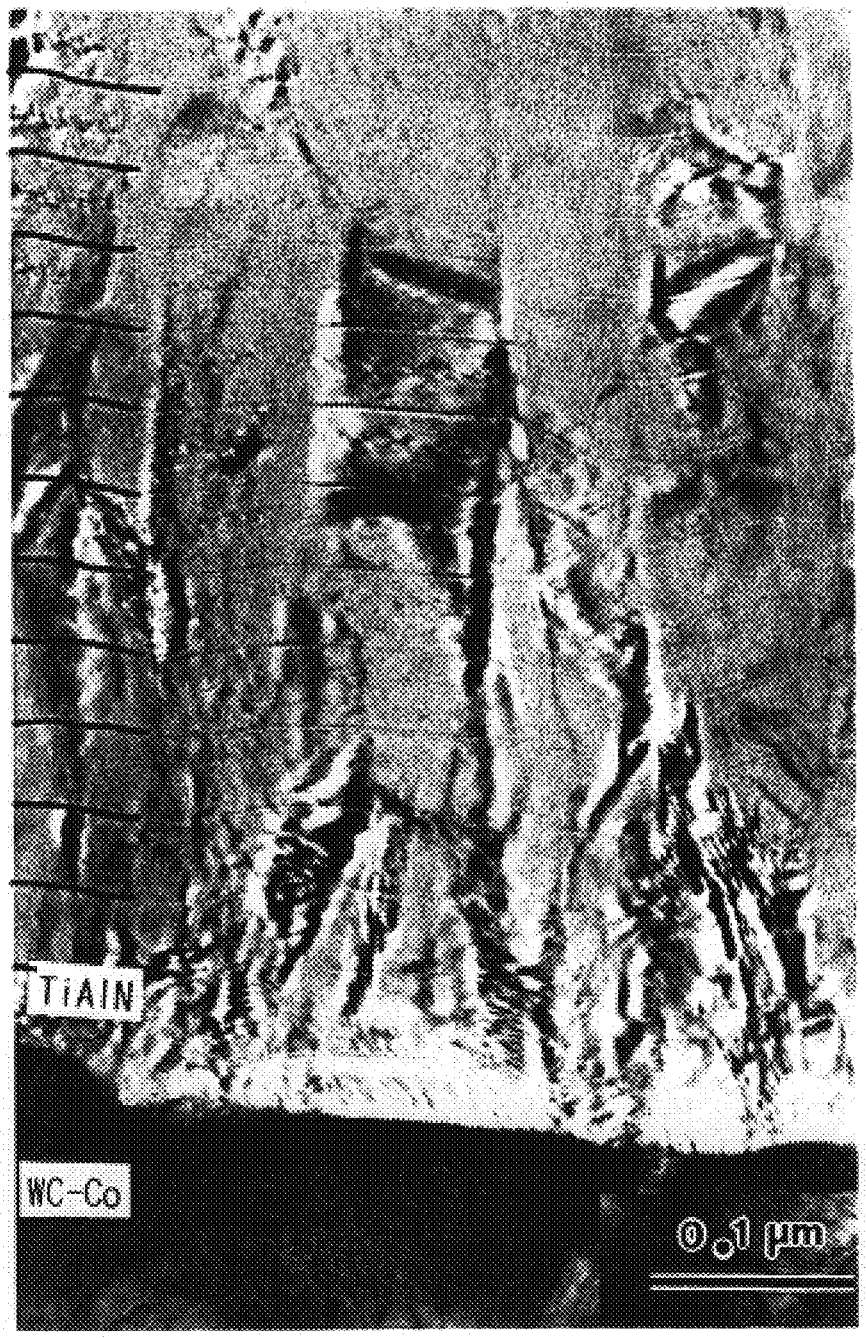
FIG. 1 is a TEM photograph showing the inner structure of the multi-layer coating in the multi-layer-coated member of the present invention.

FIG. 1 is a photograph of a transmission electron microscopy (TEM) showing the crystal structure of the multi-layer coating of the present invention. For the sake of understanding, auxiliary lines are added to the left side of the drawing to indicate the second layers. A plurality of first layers of TiAlN each having a thickness of about 0.03–0.05 $\mu$m are alternately laminated with a plurality of second layers each having a very thin thickness shown by auxiliary lines on the substrate.

Figure 2:
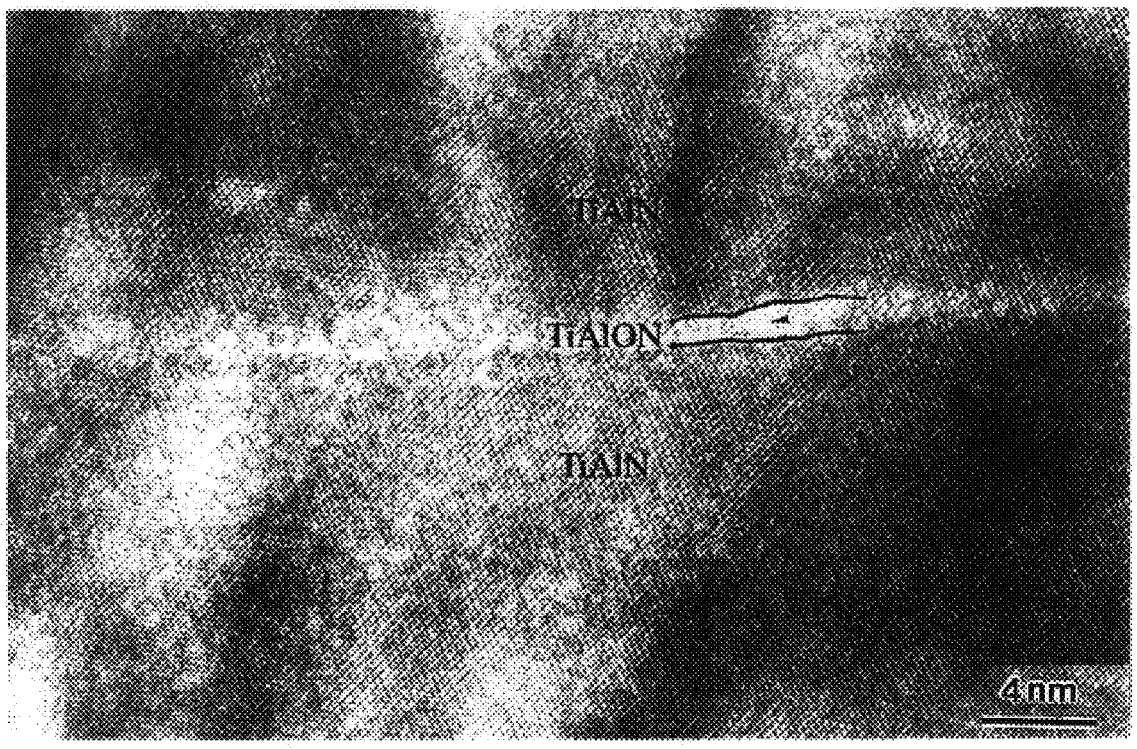
FIG. 2 is a TEM photograph at high magnification showing the inner structure of the multi-layer coating in the multi-layer-coated member of the present invention.
Figure 3:
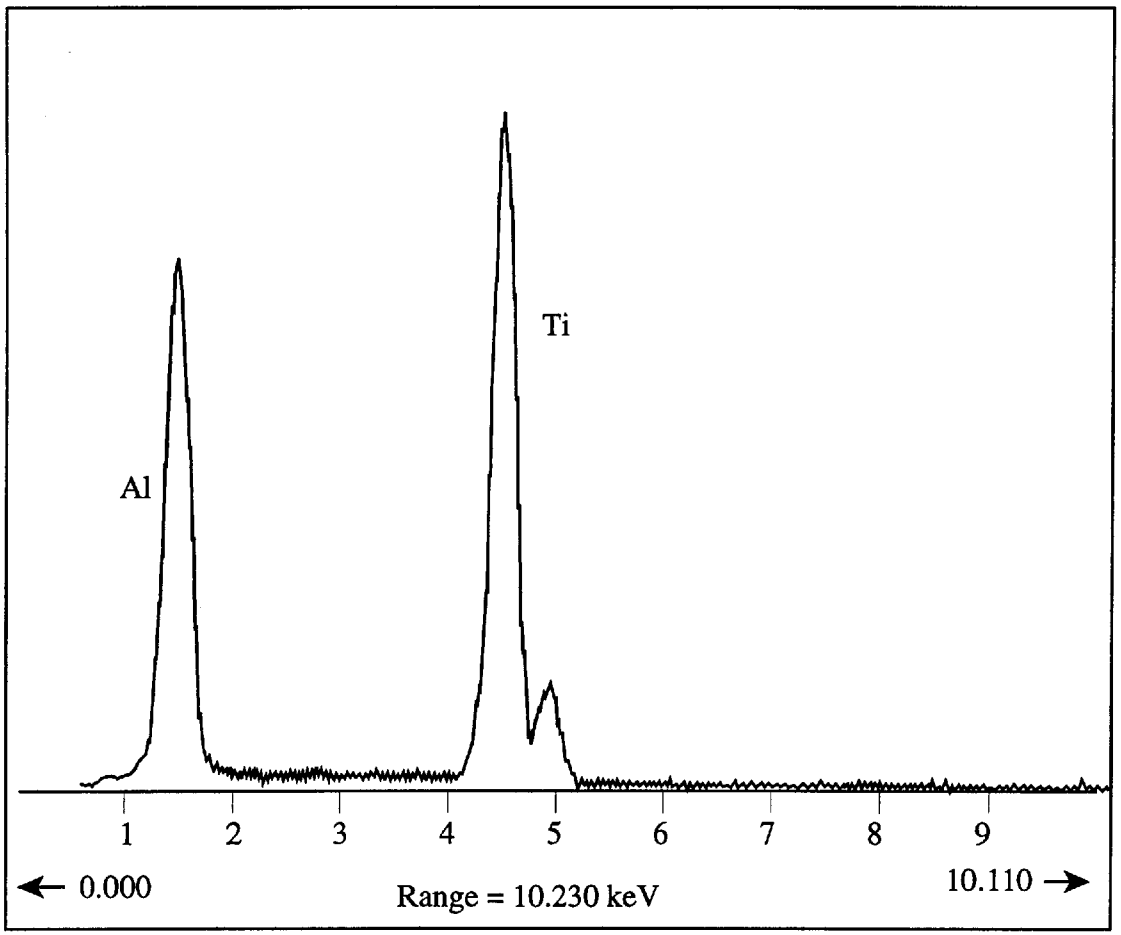
FIG. 3 is an EDX chart of the second layer of the multi-layer-coated member of the present invention.
Figure 4:
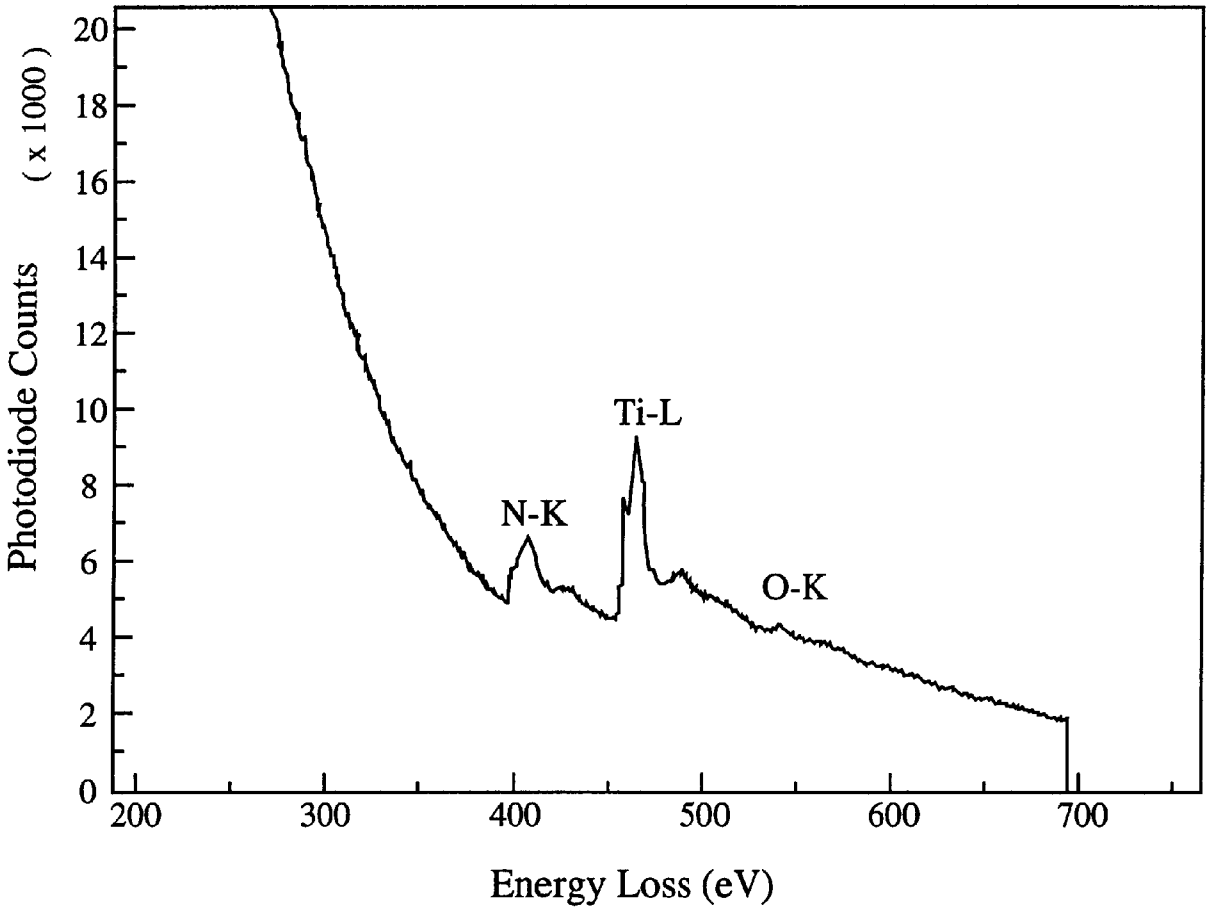
FIG. 4 is an EELS chart of the second layer of the multi-layer-coated member of the present invention.

FIG. 2 is a TEM photograph at high magnification showing the first layers and the second layers in the multi-layer-coated member of the present invention. FIGS. 3 and 4 show analysis results of the second layer by energy dispersive X-ray spectroscopy (EDX) and electron energy loss spectroscopy (EELS), respectively. From the analysis results of EDX and EELS, it has been found that the second layer is composed of compounds of Ti, Al, N and O, namely TiAlON.

Also, in FIG. 2, because the second layer is as extremely thin as about 1–2 nm, the adjacent first layers via the second layer have crystal continuity.

FIGS. 1–4 show that the multi-layer coating of the present invention comprising two or more first layers each composed of at least one selected from the group consisting of carbides, nitrides and carbonitrides of at least one element of Groups 4a, 5a and 6a of the Periodic Table and Al, and two or more second layers each composed of at least one selected from the group consisting of oxides, carboxides, oxinitrides and carboxinitrides of at least one element of Groups 4a, 5a and 6a of the Periodic Table and Al. The first layers and the second layers are laminated alternately, and there is crystal continuity between the adjacent first layers via the second layer.

In the above layer structure, the coating layers preferably have a face-centered cubic (fcc) crystal structure. In general, coatings formed by the PVD method have improved wear resistance without deteriorating the mechanical strength of the substrate. Thus, the multi-layer coating is preferably formed by the PVD method in the present invention. In this case, the multi-layer coating can stably be formed without losing crystal continuity by turning the crystal structure of the coating into an fcc structure. The coating with an fcc crystal structure has better wear resistance than coatings with other crystal structures.

The PVD method is carried out with targets having the same metal compositions as those of the layers to be formed. When the first and second layers contain two or more metals, for instance Ti and Al, targets of alloys of such metals, for instance TiAl alloy targets, are preferably used to provide the multi-layer coating having excellent uniformity.

If there were a large difference in residual stress between the first layers and the second layers at the time of forming the multi-layer coating having the above structure of the present invention, a large shear stress would exist between their boundaries due to the difference in residual stress. This shear stress deteriorates the adhesion of the coating layers.

The residual compression stress in the multi-layer coating depends on the coating conditions. In general, the coating conditions of low ion energy provide the resultant coating layers with low residual stress, while the coating conditions of high ion energy provide the resultant coating layers with high residual stress.

According to research by the inventor, crystals in the coating tend to be aligned along the (200) face. Thus, the multi-layer coating is provided with increased adhesion and wear resistance by having continuous crystals and by aligning crystal orientation along the (200) face.

The ion energy is determined mainly by the bias voltage applied to the substrate and the degree of vacuum at the time of coating formation. Thus, to have crystal orientation along the (200) face, these conditions should be optimized. The crystal orientation may be determined by X-ray diffraction.

Known as polycrystalline superlattice coatings are thin TiN/VN superlattice layers formed by an ion plating method utilizing vacuum arc discharge, and they provide extremely hard coatings, as it is reported that the thin layers have the maximum hardness at a laminate cycle of 5.2 nm.

The inventor has found that when the second layer is extremely thin, for instance, several nanometers in the multi-layer-coated member of the present invention, it has a lattice structure very similar to such a superlattice structure. Because the first layer in the multi-layer coating of the present invention is relatively too thick to have a superlattice structure, the structure of the first layer is called "pseudo superlattice" herein. In the case of the multi-layer-coated member having such a pseudo superlattice structure, it is expected that the coating per se has high hardness. Also, because adjacent layers are strongly bonded, the resultant coating is provided with higher wear resistance.

The addition of various third components to the first layers has been attempted to improve the oxidation resistance of the first layers in the multi-layer coating of the present invention. As a result, it has been found that the addition of Si and/or Group 3a metals such as Y, Nd, Sm and Sc improves the oxidation resistance of the first layer. These components are segregated in crystal grain boundaries of the first layer, thereby suppressing oxygen diffusion in the crystal grain boundaries, which leads to improvement in the oxidation resistance of the multi-layer coating.

When the total amount of the third components is less than 1 atomic %, effects of improving oxidation resistance cannot be obtained. On the other hand, when it exceeds 30 atomic %, the multi-layer coating has deteriorated wear resistance. Thus, the total amount of the third components is preferably 1–30 atomic %, more preferably 1–10 atomic %.

The second layer in the multi-layer-coated member of the present invention is an oxygen-containing layer that functions to prevent oxygen diffusion inside the multi-layer coating and it has a crystal structure continuous with the first layer, thereby exhibiting excellent adhesion between the adjacent layers to prevent peeling during the cutting operation.

When the thickness of the second layer is less than 1 nm, effects of improving oxidation resistance are not obtained. On the other hand, when it exceeds 200 nm, breakage takes place in the oxide, which is likely to cause peeling of the multi-layer coating. Thus, the thickness of each second layer is preferably 1–200 nm, more preferably 1–100 nm. To obtain the effects of pseudo superlattice structure, the thickness of the second layer is particularly 1–10 nm.

Each of the first layers may have a thickness of 5–1000 nm. When the thickness of each first layer is less than 5 nm, the number of the first layers is too many to form the multi-layer coating at low cost. On the other hand, when it exceeds 1000 nm, effects of interposing the second layer are not obtained. The more preferred thickness of each first layer is 20–500 nm.

When the outermost layer of the multi-layer coating is composed of oxides, carboxides, oxinitrides or carboxinitrides of elements of Groups 4a, 5a and 6a of the Periodic Table and/or Al, oxidation resistance and galling resistance are improved at the initial stage of cutting, thereby achieving further improvement in a cutting life.

In a case where the outermost layer has an amorphous structure, further improvement in oxidation resistance can be obtained. Because oxygen is predominantly diffused in the crystal grain boundaries, the outermost layer having an amorphous structure serves to suppress the diffusion of oxygen, thereby effectively improving the oxidation resistance of the multi-layer coating.

When the outermost oxide layer has a γ, κ, θ or α-crystal structure, the outermost layer is hard, improving wear resistance, though its oxidation resistance is somewhat low. Therefore, whether the outermost layer should have an amorphous structure or a crystal structure is preferably determined depending on types of cutting. In any case, when the thickness of the outermost layer is less than 5 nm, effects of improving oxidation resistance cannot be obtained. On the other hand, when it exceeds 500 nm, adhesion is deteriorated. Thus, the thickness of the outermost layer is preferably 5–500 nm, more preferably 10–200 nm.

In the multi-layer-coated member of the present invention, the innermost layer of the multi-layer coating preferably is an adhesion-strengthening layer having excellent adhesion to the substrate. An example of such an innermost layer is a TiN layer. Also, metal layers such as Ti and TiAl serve to decrease residual compression stress of the coating layers, thereby improving adhesion to each other. In any case, when the thickness of the innermost layer is less than 2 nm, no improvement in adhesion can be obtained. On the other hand, when it exceeds 5000 nm, the adhesion of the entire coating layers is deteriorated. The thickness of the innermost layer is preferably 2–5000 nm, more preferably 10–1000 nm.

The present invention will be described in detail referring to the following EXAMPLES without intention of limiting the present invention thereto.

EXAMPLE 1

Cemented carbide end mills were provided with multi-layer coatings having an innermost TiN layer, first layers, second layers and an outermost AlO layer with a small arc-ion plating apparatus under the coating conditions shown in Table 1.

TABLE 1

| | | Bias | Reaction Gas | | |
|---|---|---|---|---|---|
| Layer | Target | Voltage (V) | Composition | Pressure (mbar) | Temp. (° C.) |
| Innermost | Ti | −300 | $N_2$ | $4 \times 10^{-2}$ | 450 |
| First | TiAl Alloy | −300 | $N_2$ | $4 \times 10^{-2}$ | 450 |
| Second | TiAl Alloy | −300 | $N_2 + O_2$ | $4 \times 10^{-2}$ | 450 |
| Outermost | Al | −300 | $Ar + O_2$ | $4 \times 10^{-2}$ | 450 |

The compositions and thickness of the first, second and+ outermost layers are shown in Table 2. The innermost layer was to improve adhesion to the substrate. Because the total thickness of the multi-layer coating was 2.5 μm, the total number of the first and second layers was different depending on the sample. Incidentally, the first TiAlN layers and the second TiAlON layers were formed by intermittently introducing oxygen gas to the reaction gas.

TABLE 2

| | Inner Layer | | | Cutting Length until | Depth of Oxidized |
|---|---|---|---|---|---|
| Sample No.(1) | First Layer | Second Layer | Outermost Layer | Breakage (m) | Layer (nm) |
| 1 | $Ti_{0.5}Al_{0.5}N$ (40 nm) | TiAlON(2) (5 nm) | AlO(3) (100 nm) | 21.5 | 52 |
| 2 | $Ti_{0.5}Al_{0.5}N$ (40 nm) | TiAlON(2) (5 nm) | AlO(3) (100 nm) | 27.3 | 0 |
| 3 | $Ti_{0.5}Al_{0.5}N$ (40 nm) | TiAlON(3) (30 nm) | AlO(3) (100 nm) | 21.2 | 40 |

TABLE 2-continued

| Sample No.[1] | Inner Layer: First Layer | Inner Layer: Second Layer | Outermost Layer | Cutting Length until Breakage (m) | Depth of Oxidized Layer (nm) |
|---|---|---|---|---|---|
| 4 | $Ti_{0.5}Al_{0.5}N$ (40 nm) | TiAlON[3] (100 nm) | AlO[3] (100 nm) | 16.3 | 50 |
| 5 | $Ti_{0.5}Al_{0.5}N$ (40 nm) | TiAlON[2] (5 nm) | AlO[3] (100 nm) | 33.9 | 0 |
| 6 | $Ti_{0.5}Al_{0.5}N$ (40 nm) | TiAlON[2] (5 nm) | AlO[3] (100 nm) | 28.7 | 10 |
| 7 | $Ti_{0.5}Al_{0.5}N$ (100 nm) | TiAlON[2] (5 nm) | AlO[3] (100 nm) | 22.6 | 30 |
| 8 | $Ti_{0.5}Al_{0.5}N$ (200 nm) | TiAlON[2] (5 nm) | AlO[3] (100 nm) | 15.7 | 60 |
| 9 | $Ti_{0.6}Zr_{0.4}N$ (40 nm) | TiAlON[2] (5 nm) | AlO[3] (100 nm) | 18.5 | 55 |
| 10 | $Ti_{0.6}Cr_{0.4}N$ (40 nm) | TiAlON[2] (5 nm) | AlO[3] (100 nm) | 18.5 | 55 |
| 11 | $Ti_{0.4}Al_{0.3}Nb_{0.3}N$ (40 nm) | TiAlON[2] (5 nm) | AlO[3] (100 nm) | 30.8 | 5 |
| 12 | $Ti_{0.6}Hf_{0.4}N$ (40 nm) | TiAlON[2] (5 nm) | AlO[3] (20 nm) | 19.9 | 0 |
| 13 | TiN (2.5 μm) | — | — | 0.5 | Totally oxidized |
| 14 | TiCN (2.5 μm) | — | — | 1.2 | Totally oxidized |
| 15 | $Ti_{0.5}Al_{0.5}N$ (2.5 μm) | — | — | 7.8 | 2460 |
| 16 | $Ti_{0.4}Al_{0.6}N$ (2.5 μm) | — | — | 8.5 | 2200 |
| 17 | $Ti_{0.3}Al_{0.7}N$ (2.5 μm) | — | — | 7.5 | 2050 |

Note:
[1]Sample Nos. 1–12 are within the present invention, and Sample Nos. 13–17 are outside the present invention.
[2]Having an fcc crystal structure.
[3]Having an amorphous structure.

With respect to Sample Nos. 1, 2, 6 and 9 within the present invention, the second layers were observed by TEM. As a result, it was found that they had substantially the same crystal structure as those of the adjacent first layers. Also, substantially no misfit dislocation, disturbance of crystal lattice, was observed in boundaries between the first and second layers, confirming that they had a pseudo-superlattice structure.

The resultant end mills were subjected to a cutting test until breakage took place under the cutting conditions indicated below. Cutting length until breakage is also shown in Table 2.

End mill: 8 mm in diameter, 6 teeth,

Workpiece to be cut: SKD 11 having hardness HRC of 60,

Cutting speed: 40 m/min.,

Feed: 0.06 mm/tooth,

Cutting depth: 12 mm×0.8 mm, and

Cutting: dry.

Next, an oxidation test was carried out at 1000° C. for 30 minutes in the air to measure the depth of an oxidized layer. The results are shown in Table 2.

It is clear from Table 1 that with the second TiAlON layer having an fcc crystal structure for providing crystal continuity, the coating layers have extremely improved oxidation resistance, exhibiting excellent performance in cutting of hardened high-hardness materials.

In the case of cutting steel having hardness HRC of 60 under the above conditions, it was confirmed that tooth temperatures were elevated to 950° C. Also, in the case of steel having hardness HRC of 50, tooth temperatures were elevated to 950° C. under the same conditions as above except for a cutting speed of 120 m/min.

This verifies that the multi-layer-coated members of the present invention exhibit excellent cutting performance under such severe conditions that teeth are heated to temperatures exceeding 950° C., regardless of the hardness of workpieces to be cut. Such advantages are obtained particularly in the case of dry cutting.

EXAMPLE 2

Cemented carbide drills and cemented carbide inserts were provided with the same multi-layer coatings as in EXAMPLE 1 to conduct a cutting test under conditions given below. In the case of drills, wear was measured after drilling 3000 holes. Also, in the case of inserts, wear of flanks was measured after 10 m of cutting. The results are shown in Table 3.

Drilling conditions (wet drilling)

Drill: 6 mm in diameter (P40 grade),

Workpiece to be cut: SCM 440 (annealed),

Cutting speed: 100 m/min.,

Feed: 0.1 mm/rev., and

Hole depth: 15 mm.

Cutting conditions with insert

Insert: SEE42TN (P40 grade),

Workpiece to be chamfered: SKD 61 having hardness HRC of 42 (100 mm in width, 250 mm in length), Cutting speed: 150 m/min., Feed: 0.15 m/rev., and Cutting depth: 1.5 mm.

TABLE 3

| Sample No.[1] | Wear of Drill (mm) | Wear of Insert (mm) |
|---|---|---|
| 1 | 0.235 | 0.140 |
| 2 | 0.223 | 0.135 |
| 3 | 0.254 | 0.155 |
| 4 | 0.266 | 0.170 |
| 5 | 0.171 | 0.105 |
| 6 | 0.216 | 0.125 |
| 7 | 0.241 | 0.158 |
| 8 | 0.299 | 0.179 |
| 9 | 0.188 | 0.110 |
| 10 | 0.272 | 0.167 |
| 11 | 0.181 | 0.095 |
| 12 | 0.236 | 0.147 |
| 13 | 1500[2] | 0.525(5m) |
| 14 | 2200[2] | 0.432(5m) |
| 15 | 2900[2] | 0.311 |
| 16 | 0.395 | 0.300 |
| 17 | 0.421 | 0.352 |

Note:
[1]Sample Nos. 1–12 are within the present invention, and Sample Nos. 13–17 are outside the present invention.
[2]Drill was broken when holes were drilled in indicated numbers.

It is clear from Table 3 that the multi-layer-coated members of the present invention exhibit excellent tool life in both cases of drills and inserts. This tendency is similarly shown in end mills, drills and inserts.

EXAMPLE 3

Cemented carbide end mills and inserts were provided with multi-layer coatings having an innermost TiN layer, first layers, second layers and an outermost layer under the conditions shown in Table 4 with a small arc-ion plating apparatus. The crystallization of the outermost layer was at 790° C. for α-crystal and at 680° C. for γ-crystal.

TABLE 4

| Layer | Target | Bias Voltage (V) | Reaction Gas Composition | Reaction Gas Pressure (mbar) | Reaction Gas Temp. (° C.) |
|---|---|---|---|---|---|
| Innermost | Ti | −300 | $N_2$ | $4 \times 10^{-2}$ | 450 |
| First | TiAl Alloy | −300 | $N_2$ | $4 \times 10^{-2}$ | 450 |
| Second | TiAl Alloy | −300 | $N_2 + O_2$ | $4 \times 10^{-2}$ | 450 |
| Outermost | Al | −300 | $Ar + O_2$ | $4 \times 10^{-2}$ | 790(1) 680(2) |

Note:
(1)Crystallization temperature for α-crystal.
(2)Crystallization temperature for γ-crystal.

The compositions and thickness of the first, second and outermost layers are shown in Table 5. The total thickness of the multi-layer coating was 2.5 μm. Incidentally, the first TiAlN layer and the second TiAlON layer were formed by intermittently introducing oxygen gas to the reaction gas.

With respect to samples within the present invention and those outside the present invention, cutting performance was evaluated under the cutting conditions shown in EXAMPLES 1 and 2. The results are shown in Table 5. Also, an oxidation test was carried out at 1000° C. for 2 hours in the air to measure the thickness of oxidized layers. The results are also shown in Table 5.

TABLE 5

| Sample No.(1) | First Layer | Second Layer | Outermost Layer | Cutting Length of End mill (m) | Wear of Insert (mm) | Thickness of Oxidized Layer (nm) |
|---|---|---|---|---|---|---|
| 18 | $Ti_{0.5}Al_{0.5}N$ (50 nm) | TiAlON(2) (10 nm) | α-AlO (30 nm) | 39.9 | 0.055 | 500 |
| 19 | $Ti_{0.5}Al_{0.5}N$ (50 nm) | TiAlON(2) (10 nm) | γ-AlO (30 nm) | 31.4 | 0.082 | 630 |
| 20 | $Ti_{0.5}Al_{0.5}N$ (50 nm) | TiAlON(2) (10 nm) | AlO(3) (30 nm) | 26.3 | 0.075 | 425 |
| 21 | $Ti_{0.5}Al_{0.5}N$ (50 nm) | TiAlON(2) (10 nm) | AlON(3) (30 nm) | 21.9 | 0.091 | 490 |
| 22 | $Ti_{0.5}Al_{0.5}N$ (50 nm) | TiAlON(2) (10 nm) | AlCON(3) (30 nm) | 21.7 | 0.109 | 550 |
| 23 | $Ti_{0.5}Al_{0.5}N$ (50 nm) | TiAlON(3) (10 nm) | AlON(3) (30 nm) | 17.2 | 0.181 | 610 |
| 15 | $Ti_{0.5}Al_{0.5}N$ (2.5 μm) | — | — | 7.8 | 0.311 | Totally oxidized |
| 16 | $Ti_{0.4}Al_{0.6}N$ (2.5 μm) | — | — | 8.5 | 0.300 | Totally oxidized |
| 17 | $Ti_{0.3}Al_{0.7}N$ (2.5 μm) | — | — | 7.5 | 0.352 | Totally oxidized |

Note:
(1)Sample Nos. 18–23 are within the present invention, and Sample Nos. 15–17 are COMPARATIVE EXAMPLES.
(2)Having an fcc crystal structure.
(3)Having an amorphous structure.

It is clear from Table 5 that the multi-layer coatings of the present invention exhibit excellent oxidation resistance and cutting life. With oxygen-containing layers disposed inside the multi-layer coatings, drastic improvement in oxidation resistance and tool life is obtained.

EXAMPLE 4

Cemented carbide end mills were provided with multi-layer coatings having first layers, second layers and an outermost layer, using TiAlX alloy targets containing a third component X, wherein X was Si, Nd, Y, Sc or Sm, under the same conditions as in EXAMPLE 1 with a small arc-ion plating apparatus. Each second layer was a 5-nm-thick TiAlON layer having an fcc crystal structure, and the outermost layer was an amorphous AlO layer. The total thickness of the multi-layer coating was 2.5 μm. The same cutting evaluation as in EXAMPLE 1 and the same oxidation test as in EXAMPLE 3 were conducted. The results are shown in Table 6.

TABLE 6

| Sample No.(1) | First Layer | Outermost Layer | Cutting Length of End mill (m) | Thickness of Oxidized Layer (nm) |
|---|---|---|---|---|
| 24 | $Ti_{0.48}Al_{0.48}Si_{0.04}N$ (40 nm) | AlO(2) (100 nm) | 24.5 | 535 |
| 25 | $Ti_{0.45}Al_{0.45}Si_{0.10}N$ (40 nm) | AlO(2) (100 nm) | 33.2 | 475 |
| 26 | $Ti_{0.40}Al_{0.40}Si_{0.20}N$ (40 nm) | AlO(2) (100 nm) | 28.1 | 585 |
| 27 | $Ti_{0.38}Al_{0.38}Si_{0.24}N$ (40 nm) | AlO(2) (100 nm) | 24.2 | 590 |
| 28 | $Ti_{0.45}Al_{0.45}Nd_{0.10}N$ (40 nm) | AlO(2) (100 nm) | 35.5 | 525 |
| 29 | $Ti_{0.40}Al_{0.40}Nd_{0.20}N$ (40 nm) | AlO(2) (100 nm) | 27.5 | 475 |
| 30 | $Ti_{0.45}Al_{0.45}Y_{0.10}N$ (40 nm) | AlO(2) (100nm) | 32.4 | 355 |
| 31 | $Ti_{0.40}Al_{0.40}Y_{0.20}N$ (40 nm) | AlO(2) (100 nm) | 23.6 | 565 |
| 32 | $Ti_{0.45}Al_{0.45}Sc_{0.10}N$ (40 nm) | AlO(2) (100 nm) | 21.7 | 630 |
| 33 | $Ti_{0.40}Al_{0.40}Sc_{0.20}N$ (40 nm) | AlO(2) (100 nm) | 30.5 | 645 |
| 34 | $Ti_{0.45}Al_{0.45}Sm_{0.10}N$ (40 nm) | AlO(2) (100 nm) | 29.9 | 435 |
| 35 | $Ti_{0.40}Al_{0.40}Sm_{0.20}N$ (40 nm) | AlO(2) (100 nm) | 26.3 | 510 |
| 2 | $Ti_{0.5}Al_{0.5}N$ (40 nm) | AlO(2) (100 nm) | 27.3 | 1290 |
| 15 | $Ti_{0.5}Al_{0.5}N$ (2.5 μm) | — | 7.8 | Totally oxidized |
| 16 | $Ti_{0.4}Al_{0.6}N$ (2.5 μm) | — | 8.5 | Totally oxidized |
| 17 | $Ti_{0.3}Al_{0.7}N$ (2.5 μm) | — | 7.5 | Totally oxidized |

Note:
(1)Sample Nos. 24–35 and 2 are within the present invention, and Sample Nos. 15–17 are outside the present invention.
(2)Having an amorphous structure.

It is clear from Table 6 that the third components provide the multi-layer-coated members of the present invention with improved oxidation resistance and cutting life.

As described in detail above, in the multi-layer coating of the present invention, the first layers composed of carbides, nitrides, etc., are alternately laminated with the oxygen-containing second layers so thin as to provide the adjacent first layers with crystal continuity. The first layers preferably have an fcc crystal structure and crystal orientation along the (200) face. Further, the first layers preferably have pseudo superlattice structure. Because of these structural features, the multi-layer-coated members of the present invention have enough oxidation resistance and adhesion to be capable of withstanding severe cutting conditions.

The multi-layer-coated members of the present invention having such advantages are suitable for coated tools such as drills, end mills and inserts usable under severe conditions such as high-speed cutting.

What is claimed is:

1. A multi-layer-coated member composed of an ultra-hard alloy substrate and a multi-layer coating formed thereon, wherein said multi-layer coating comprises two or more first layers and two or more second layers laminated alternately, said first layer being composed of at least one member selected from the group consisting of carbides, nitrides and carbonitrides comprising two or more elements selected from the group consisting of elements of Groups 4a, 5a and 6a of the Periodic Table and Al, and said second layer being composed of at least one member selected from the group consisting of oxides, carboxides, oxinitrides and carboxinitrides comprising two or more elements selected from the group consisting of elements of Groups 4a, 5a and 6a of the Periodic Table and Al.

2. The multi-layer-coated member according to claim 1, wherein said first layers adjacent via said second layer have crystals oriented substantially in the same direction.

3. The multi-layer-coated member according to claim 1, wherein said first layers have an fcc crystal structure.

4. The multi-layer-coated member according to claim 1, wherein said first layer comprises 1–30 atomic % of at least one additional element selected from the group consisting of Si, Y, Nd, Sm and Sc.

5. The multi-layer-coated member according to claim 1, wherein said multi-layer coating has an outermost layer composed of at least one member selected from the group consisting of oxides, carboxides, oxinitrides and carboxinitrides of at least one element of Groups 4a, 5a and 6a of the Periodic Table and Al.

6. The multi-layer-coated member according to claim 5, wherein said outermost layer is composed of at least one selected from the group consisting of oxides, carboxides, oxinitrides and carboxinitrides of Ti and Al.

7. The multi-layer-coated member according to claim 5, wherein said outermost layer is composed of at least one member selected from the group consisting of oxides, carboxides, oxinitrides and carboxinitrides of Ti, Si and Al.

8. The multi-layer-coated member according to claim 5, wherein said outermost layer is composed of at least one member selected from the group consisting of oxides, carboxides, oxinitrides and carboxinitrides of Al.

9. The multi-layer-coated member according to claim 3, wherein said outermost layer has an amorphous structure.

10. The multi-layer-coated member according to claim 3, wherein said outermost layer has a crystal structure.

11. The multi-layer-coated member according to claim 1, wherein said multi-layer coating has an innermost layer having excellent adhesion to said substrate, said innermost layer being composed of at least one of TiN, TiCN, Ti and TiAl and having a thickness from 2 nm to 5000 nm.

12. The multi-layer-coated member according to claim 1, wherein the crystal orientation of said first layer determined by the maximum intensity of X-ray diffraction is aligned along the (200) face.

13. The multi-layer-coated member according to claim 1, wherein said first layer has a thickness of 5–1000 nm.

14. The multi-layer-coated member according to claim 1, wherein said second layer has a thickness of 1–200 nm.

15. The multi-layer-coated member according to claim 5, wherein said outermost layer has a thickness of 5–500 nm.

* * * * *